US005918308A

United States Patent [19]

Hunter

[11] Patent Number: 5,918,308

[45] Date of Patent: Jun. 29, 1999

[54] NON-INTEGRATING METHOD OF DERIVING SAFE SEPARATION DISTANCE BASED ON TIME

[75] Inventor: Donald W. Hunter, Silver Spring, Md.

[73] Assignee: The United States of America as represented by the Secretary of the Army, Washington, D.C.

[21] Appl. No.: 08/851,389

[22] Filed: May 5, 1997

[51] Int. Cl.[6] ..... F42C 17/00

[52] U.S. Cl. ..... 89/6.5

[58] Field of Search ..... 89/6.5, 6; 102/215, 102/206; 244/3.11

[56] References Cited

U.S. PATENT DOCUMENTS

| | | | |
|---|---|---|---|
| 3,695,142 | 10/1972 | Benson et al. | 89/6.5 |
| 3,955,069 | 5/1976 | Ziemba | 89/6.5 |
| 4,686,885 | 8/1987 | Bai | 89/6.5 |
| 4,739,705 | 4/1988 | Hudson et al. | 102/206 |
| 5,245,926 | 9/1993 | Hunter | 102/215 |
| 5,255,608 | 10/1993 | Min et al. | 102/206 |

*Primary Examiner*—Charles T. Jordan
*Assistant Examiner*—Theresa M. Wesson
*Attorney, Agent, or Firm*—Paul S. Clohan, Jr.; Frank Dynda

[57] ABSTRACT

A method for deriving a safe separation distance of a missile based on time to safe separation distance and adjustments to this time. The method comprises periodically sampling an accelerometer signal at specific time intervals. The acceleration values are compared to a reference table having time adjustment values as a function of acceleration values. These adjustment values can be added to or subtracted from the current time to safe separation distance, or they can be mathematically manipulated in order to calculate the approximate time to safe separation for the specific trajectory of the missile. Based upon the comparison, the time to safe separation distance is periodically adjusted and monitored until its value approaches zero at a safe separation distance. In the case of obtaining unacceptable deviation from the acceleration and time profile, this may be an indication of fault and a basis for termination of arming of the missile.

3 Claims, 3 Drawing Sheets

NON-INTEGRATING METHOD OF DERIVING SAFE SEPARATION DISTANCE BASED ON TIME

BACKGROUND OF THE INVENTION

1. Field of the Invention

The present invention relates to a method of deriving safe separation distance of a missile based on time and acceleration, and more particularly to adjustments to this time for arriving at a safe separation distance for arming an electronic safe and arm in a missile.

2. Discussion of Related Art

Previously disclosed and known methods of deriving safe separation distance of a missile include using an escapement controlled mass displacement integration technique, or to double integrate an output signal of an accelerometer. These methods incorporate the use of a mechanical accelerometer for producing a voltage proportional to the acceleration of the missile used in combination with an analog circuit having operational amplifier integrators. Recently, micro machined accelerometers have been used together with analog to digital converters or pulse-train output signals. These signals are digitally double integrated in gate array ASICs or microcomputers.

Publications in physics and mechanical engineering texts provide a general discussion of Newtonian Mechanics and may include concepts for integrating acceleration to derive velocity and distance of a missile or a similar object. Publications and other reports disclose missile applications using double integration methods. Another source for information regarding safe separation of a missile is critical design review presentations and Army Fuze Safety Review Board presentations.

While the above described method functions adequately, it has a few drawbacks. The major drawback is that for all known applications where safe separation distance is derived, only double integration methods are used. In these applications, none of the descriptions mention the concept of measuring time to actual safe separation distance or the adjustment of this time for deriving a safe separation distance.

Furthermore, the integration method of deriving distance is complex both in terms of the quantity of hardware required, and the complexity of logic required in an ASIC or the complexity of algorithms required in a micro-computer. Both the digital ASIC and the microcomputer processing of the double integration method provide numerous categories in which errors can occur due to time delays during sampling and data processing.

Other issues in the application of the double integration method in calculating the safe separation distance include response to malfunctions of the acceleration sensor, processing circuits, guidance system and other missile functions. Although it is relatively easy to detect a full scale failure induced response, it is difficult to detect other significant deviations from a valid acceleration and time profile. A malfunction of any or all of the above responses could result in premature derivation of safe separation distance.

One solution in reducing the effects of these types of malfunction is to provide frequent monitoring of the acceleration profile during missile flight. To incorporate this type of monitoring using the double integration method cannot be effectively achieved. Frequent monitoring of the acceleration profile or profiles of the missile with the integration method would add considerable complexity. The analog and ASIC digital circuits disclosed in the prior art would be complex, and a micro-computer based system requires timing functions, data transfer and event monitoring in addition to sensor processing. To add comprehensive profile monitoring would greatly increase the complexity of the interrupt structure and introduce additional processing errors.

Therefore, what is desirable is a method of deriving safe separation distance for arming a missile based on calculating time to safe separation distance and making adjustments to this time based upon deviations from an acceleration profile or profiles of the missile.

SUMMARY OF THE INVENTION

It is therefore an object of the present invention to monitor the acceleration of a missile at periodic intervals of the trajectory, so that arming at a safe separation distance based upon time and acceleration data may be achieved.

Additionally, it is a further object of the invention to compare the acceleration values being received to a reference-profile or profiles provided in a micro-computer. A reference table based on derivations and sub-tables therein are addressed, and provide information to periodically adjust the time to safe separation distance from the reference acceleration profile.

Furthermore, it is a further object of the invention to determine any necessary adjustments to the time to safe separation distance information of the missile as each acceleration signal value is received.

In accordance with the invention, a method of deriving accurate arming and safe separation distance of a missile is disclosed, comprising the steps of sampling an accelerometer signal and processing the signal, obtaining time adjustment values for time to safe separation distance of the missile from a table, and adjusting the time to safe separation distance of the missile.

BRIEF DESCRIEPTION OF THE DRAWINGS

The present invention will now be described in detail with reference to the attached drawings in which.

DETAILED DESCRIPTION OF THE PREFERRED EMBODIMENTS

This invention discloses a method of deriving safe separation distance of a missile based upon two primary factors, time and acceleration. In order to establish a safe separation distance of the missile periodic adjustments of the time for arming the missile may be necessary.

In a trajectory of a missile, a reference acceleration-time profile defines the nominal characteristics of a missile in flight. For different environmental temperatures there may be multiple profiles. A missile which follows a known trajectory has a time to safe separation distance which can be calculated prior to flight. In addition, with the ability to receive a signal of the acceleration of the missile at a specific time interval allows us to adjust the time to safe separation distance of the missile during the same time interval. Sampling of acceleration and time values at preselected intervals for a missile may be stored in a micro-computer.

Accordingly, the path and profile of the missile may be monitored for determining the tolerance band of the missile, as well as calculating the time to safe separation distance of the missile with each acceleration signal received.

Figure 1:
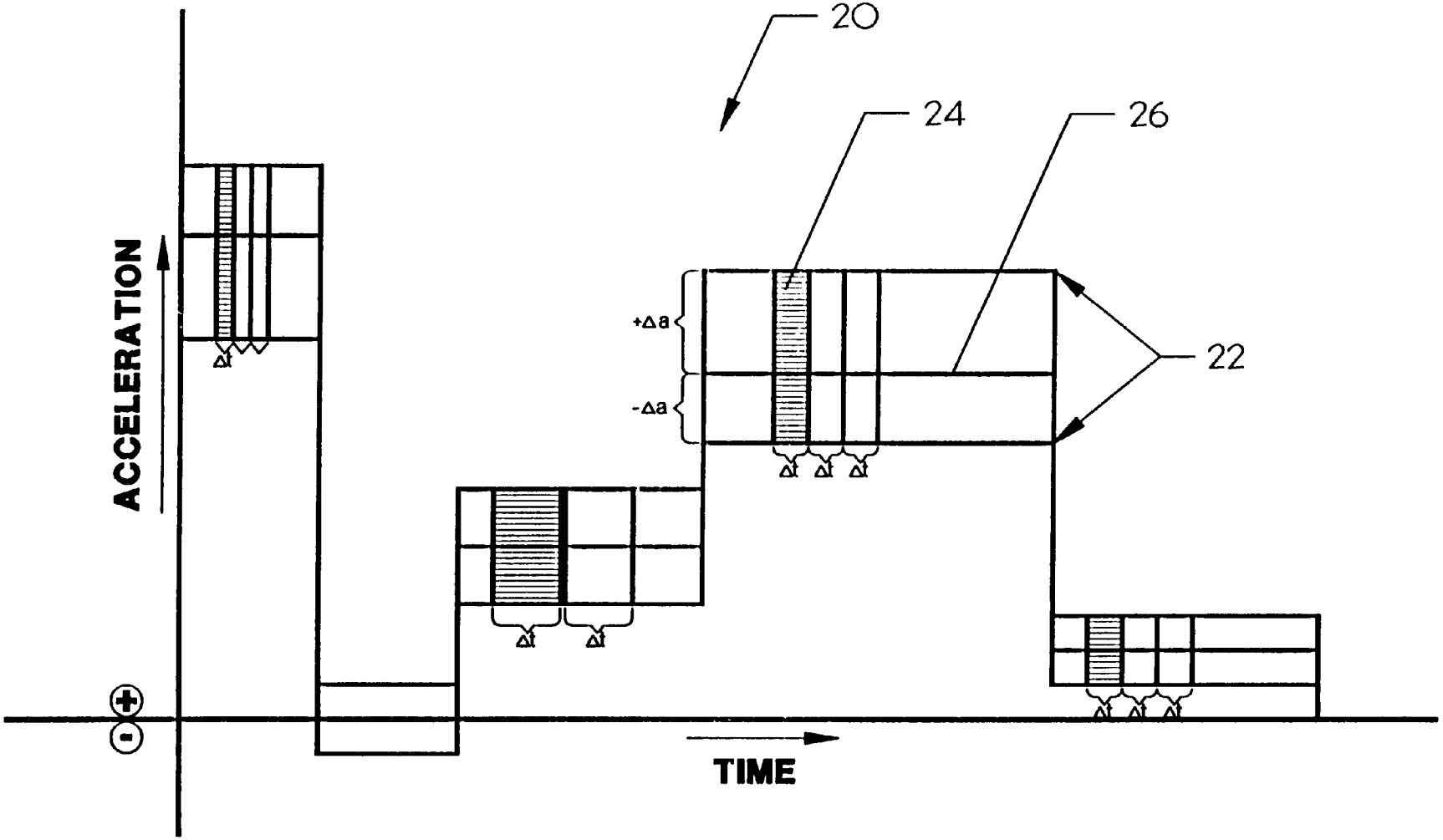
FIG. 1 is an illustration of a reference acceleration-time profile and a sampling method.

Acceleration values of the missile in flight which deviate from the reference profile produce deviations in both velocity and time to safe separation distance. Such deviations normally occur from motors with different characteristics or temperature effects, but are not limited to such factors. FIG. 1 illustrates a graph, 20, of an acceleration and time profile of the trajectory of a missile and a sampling method. The graph shows acceptable acceleration values of the missile at specific time intervals. In a developed application, not shown, the reference profile of the trajectory of the missile may be displayed in the form of curves instead of the straight line rectangular shapes shown in FIG. 1. These acceleration values are obtained as part of the design process. Measurement of acceleration as a function of time for motors at various initial temperatures can be made to accumulate the required information to construct the FIG. 1 profile.

Furthermore, FIG. 1 illustrates a tolerance envelope 22, which provides the maximum and minimum acceleration values of the missile at a specific time interval 24. Within each tolerance envelope 22 is a reference acceleration profile 26, which is the nominal acceleration profile at a specific time interval 24. In a developed application there may be several different FIG. 1 profiles, each corresponding to a typical motor characteristic at a particular temperature, or range of temperatures, with the tolerance envelope 22 defining the acceptable range of acceleration values at each time interval 24. Any acceleration values outside the tolerance envelope 22 is an indication of improper performance of the missile. Such an indication may provide a basis for terminating arming of the missile. A deviation in the acceleration value, 12, may be caused by a malfunction of the missile, such as improper performance of a motor, but is not limited to such a factor. Accordingly, as the missile approaches the safe separation distance, continuous sampling of the acceleration values may no longer be necessary.

One method of identifying these reference profiles is to measure the missile or motor temperature prior to or at launch, and to store the information of the corresponding acceleration profile for a specific missile flight in either an internal micro controller read only memory (ROM) or in an external read only memory. A thermal sensor can be used to measure the initial temperature and provide this information to the micro controller. Accordingly, prior to launching of the missile, the acceleration and time profile for the temperature, or range of temperatures, that includes the measured temperature value will be selected.

Another method of identifying and selecting a flight profile is for the micro controller to compare measured acceleration values to the different missile profiles after launching of the missile. The profiles which measurements fall outside the tolerance band 22 are eliminated until one profile remains. This method may be incorporated in an application where it is impractical to include a thermal sensor. Regardless of the two methods discussed for identifying the acceleration-time profile for a specific missile flight, acceleration values are periodically sampled at time intervals 24. These time intervals may be constant from launch to safe separation distance, or they be more frequent early in the flight so as to provide more accurate adjustment for greater effects of acceleration deviations early in flight.

In addition to deriving safe separation distance and adjusting time to safe separation distance, the profiles sampling obtained may be implemented to be used as a health check on the missile. Acceleration values measured at time interval 24 which are outside the tolerance envelope 22 may be an indication of malfunctioning of the missile or electronic safe and arm. In the case where a significant number of acceleration values obtained are outside the tolerance envelope 22, a criteria can be established for aborting the arming process. Acceleration values at specific time intervals 24 are then used to address a table and sub-table that provide time adjustment values as a function of acceleration values.

Figure 2:
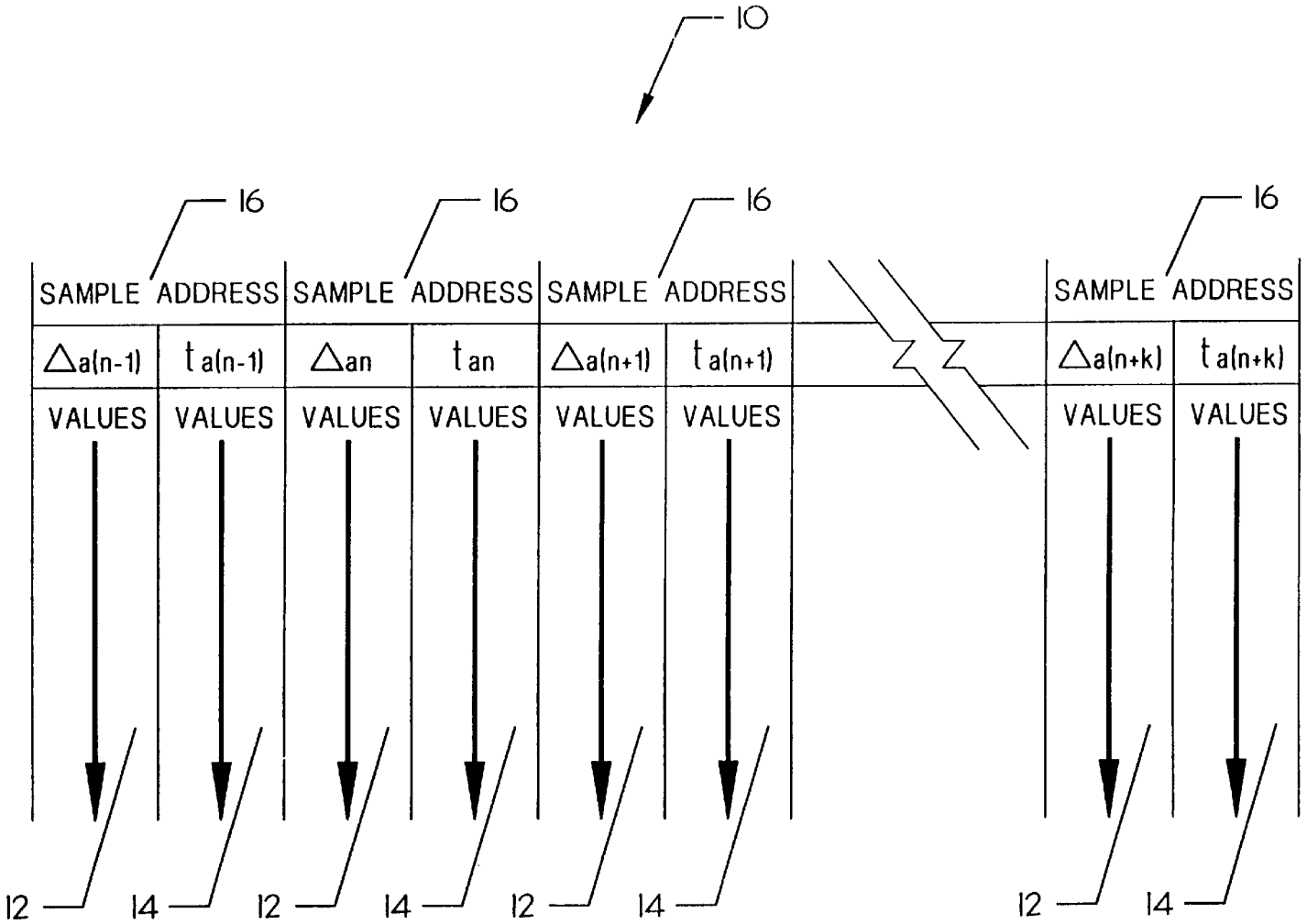
FIG. 2 is an illustration of one construction of a reference table.
Figure 3:
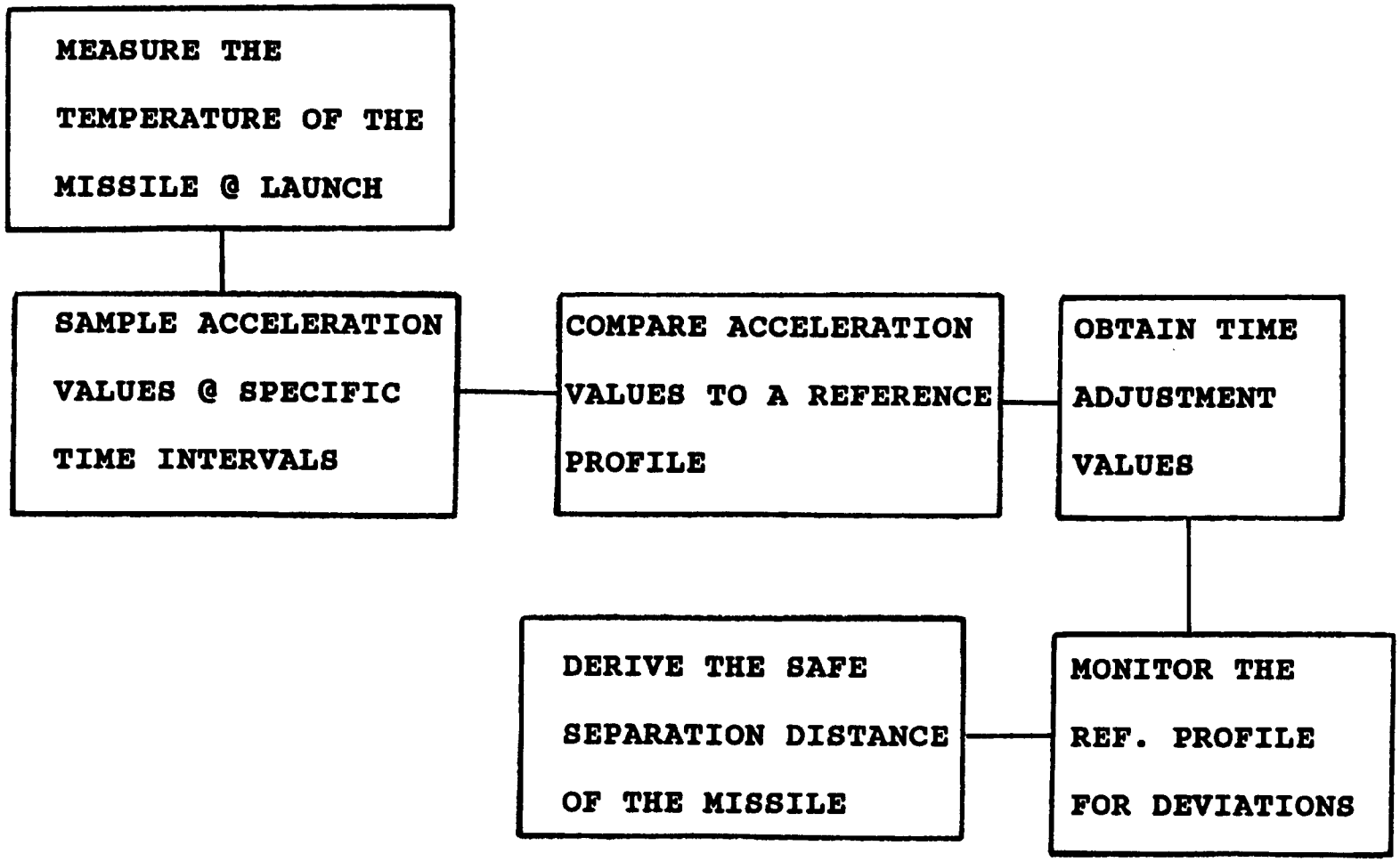
FIG. 3 is a flow chart of the method employed in this invention.

FIG. 2 displays a reference table 10, which contains sub-tables that provide time adjustment values, 14, as a function of acceleration values, 12. Each address, 16, in the reference table 10 corresponds to a time interval 24 from FIG. 1. Accordingly, each sub-table at address 16 provides time adjustment values 14 as a function of acceleration values 12, corresponding to a sample point in the trajectory of the missile. The sub-table addresses could be a base number that is incremented for each successive sampling. For time to safe separation distance in the range of 2 to 3 seconds, a constant time interval sampling of 0.1 seconds and between 10 and 20 change in acceleration values, would result in a range of 200 to 600 time adjustment values. The read only memory (ROM) specifications for the look-up table would depend upon the required precision and micro controller characteristics or external ROM chip. The time adjustment values obtained from the reference table 10 and sub-tables provide time adjustment factors for achieving an accurate time for safe separation. Accordingly, the time values can be added to or subtracted from the current time to safe separation distance value or they can be multiplied together. Regardless of the mathematical calculations implemented, the time to safe separation distance would be periodically adjusted and monitored until its value attained is zero at safe separation distance. If there is a significant discrepancy between the missile profile and the reference profile, the arming of the missile may be aborted.

Furthermore, the acceleration profile of each missile will differ according to the temperature of the motor at launch and at the initial stages of flight. When a motor is hot, the motor will cause the missile to accelerate quicker than a missile having an average temperature. Likewise a cooler motor will cause the missile to accelerate slower. As such, the initial temperature of the missile can be measured at launch so that corresponding acceleration and time values may be obtained through the profile information previously stored in the micro controller. By obtaining acceleration values of the missile at the initial stages of flight together with temperature values of the missile at the initial launch stage, the appropriate time to safe separation distance may be calculated according to profile values stored in the micro controller. Accordingly, it is beneficial to obtain a family of profiles for different motors and motor temperatures for properly calculating the time to safe separation distance and determining whether to arm or disarm the missile.

Periodic samples of acceleration values of a missile in flight are obtained through the use of an accelerometer, from launch until a safe separation distance is achieved. The sample time interval may be constant, or in the case of acceleration deviations from the profile early in the flight the time differentials to safe separation distance may be adjusted to provide a more accurate reading of the missile at more frequent intervals. As the missile approaches the safe separation distance, continuous sampling of the acceleration values may no longer be necessary.

Among the significant characteristics of the look-up table is that the look-up table is comprised of sub-tables, wherein each sub-table corresponds to a sample point and maps the acceleration interval values to the time interval values. The configuration of the look-up table and the sub-tables enables time to safe separation distance to be periodically adjusted and monitored until its value becomes zero. Accordingly, the layout of the tables in the micro controller or external ROM provides for obtaining safe separation distance and proper arming of the missile.

A practical characteristic for this novel method of deriving safe separation distance is for each sample point and time adjustment to be self-contained. Use of data from previous calculations and stored data could require complicated processing in the micro controller, which could result in an expanding data field.

Although the present invention has been described in connection with preferred embodiments thereof, it will be appreciated by those skilled in the art that additions, deletions, modifications, and substitution not specifically described may be made without departing from the spirit and scope of the invention as defined in the appended claims.

What is claimed:

1. A method of deriving a safe separation distance in an electronic safe and arm of a missile, comprising the steps of:

sampling acceleration values of the missile at specific time intervals;

comparing the acceleration values to a reference profile; and obtaining time adjustment values from a look-up table.

2. The method of claim 1, further comprising the step of monitoring the reference profile for deviations.

3. The method of claim 1, further comprising the step of measuring the temperature of the missile at launch.

* * * * *